US008104853B2

(12) United States Patent
Kim et al.

(10) Patent No.: US 8,104,853 B2
(45) Date of Patent: Jan. 31, 2012

(54) REFRIGERATOR AND METHOD OF MANUFACTURING DOOR THEREOF

(75) Inventors: Myung Soo Kim, Seoul (KR); Myung Wouk Kim, Gwanglu (KR); Yong Kyung Kim, Gwanglu (KR); Jun Seong Lim, Gwanglu (KR); Young Jin Seo, Gwanglu (KR); Jong Il Lee, Soocheon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 661 days.

(21) Appl. No.: 11/987,112

(22) Filed: Nov. 27, 2007

(65) Prior Publication Data

US 2008/0143227 A1 Jun. 19, 2008

(30) Foreign Application Priority Data

Dec. 19, 2006 (KR) ..... 10-2006-0130060

(51) Int. Cl.
*A47B 96/04* (2006.01)

(52) U.S. Cl. ..... 312/405; 312/401

(58) Field of Classification Search ..... 312/401, 312/405, 406, 400
See application file for complete search history.

(56) References Cited

U.S. PATENT DOCUMENTS

| | | | | |
|---|---|---|---|---|
| 4,583,796 | A * | 4/1986 | Nakajima et al. | 312/405 |
| 5,048,233 | A | 9/1991 | Gidseg et al. | |
| 5,358,326 | A * | 10/1994 | Cherry et al. | 312/405 |
| 5,412,839 | A * | 5/1995 | McCollom | 16/430 |
| 5,520,453 | A * | 5/1996 | Aoki et al. | 312/406 |
| 2004/0183414 | A1 * | 9/2004 | Kwon | 312/401 |
| 2005/0006997 | A1 * | 1/2005 | Yoshioka | 312/405 |
| 2006/0248824 | A1 * | 11/2006 | Cho et al. | 52/205 |
| 2008/0036350 | A1 * | 2/2008 | Crompton et al. | 312/405 |

* cited by examiner

*Primary Examiner* — Darnell Jayne
*Assistant Examiner* — Timothy M Ayres
(74) *Attorney, Agent, or Firm* — Staas & Halsey LLP

(57) ABSTRACT

Disclosed are a refrigerator and a method of manufacturing a door of the refrigerator. The door includes a door frame formed with at least one opening, at least one front panel coupled to a front surface of the door frame to open or close the opening, a rear panel coupled to a rear surface of the door frame to form a foaming cavity together with the front panel and provided with a rack receiving water bottles, and a decorative member formed at a front surface of the front panel. A chamfer is formed at an edge portion of the door frame.

12 Claims, 6 Drawing Sheets

REFRIGERATOR AND METHOD OF MANUFACTURING DOOR THEREOF

CROSS-REFERENCE TO RELATED APPLICATIONS

This application claims the benefit of Korean Patent Application No. 10-2006-0130060, filed on Dec. 19, 2006, in the Korean Intellectual Property Office, the disclosure of which is incorporated herein by reference.

BACKGROUND

1. Field

The present invention relates generally to a refrigerator and a method of manufacturing a door of the refrigerator. More particularly, the present invention relates to a refrigerator provided at the front surface thereof with a decorative member and a method of manufacturing a door of the refrigerator.

2. Description of the Related Art

In general, a refrigerator is designed to supply cold air generated from an evaporator through a refrigeration cycle to a storeroom to allow freshness of various foodstuffs to be preserved for a long time. The refrigerator mainly includes a body forming a storeroom to store foodstuffs and a door rotatably coupled to the body to open/close the storeroom.

Recently, the door is provided at the front surface thereof with a decorative member, made, for example, of wood or tempered glass, to improve the external appearance of the refrigerator. In order to manufacture the door of the refrigerator, an opening is formed in a single metallic plate by cutting out the central portion of the single metallic plate, and the edge portion of the single metallic plate is notched and bent to form a foaming space where a foaming agent is provided.

However, since the door is made from the single metallic plate, a cutting section may occur when forming the opening at the center of the door or when notching the edge portion of the door. Such a cutting section wastes the metallic plate, so the manufacturing cost for the door may increase.

In addition, since the high-expensive metallic plate is used even in regions of the door where great rigidity and strength are not necessary, the manufacturing cost and the weight of the door may increase.

Further, since the single metallic plate is bent at a right angle, not only strength of the edge portion becomes weak, but also the foaming agent is filled in a cavity defined by the edge portion. Thus, a large amount of the foaming agent is necessary, causing an increase in manufacturing cost for the door.

SUMMARY

Accordingly, it is an aspect of the present invention to solve the above-mentioned problems occurring in the related art. It is another aspect of the present invention to provide a refrigerator and a method of manufacturing a door of the refrigerator, capable of reducing the manufacturing cost of the door.

Another aspect of the present invention is to provide a refrigerator and a method of manufacturing a door of the refrigerator, capable of enhancing rigidity and strength of an edge portion of the door.

Additional aspects and/or advantages will be set forth in part in the description which follows and, in part, will be apparent from the description, or may be learned by practice of the invention.

The foregoing and/or other aspects of the present invention are achieved by providing a refrigerator comprising a body having a storeroom therein, and a door for opening/closing the storeroom, wherein the door includes a door frame formed with at least one opening, at least one front panel coupled to a front surface of the door frame so as to open or close the opening, a rear panel coupled to a rear surface of the door frame to form a foaming cavity together with the front panel, the foaming cavity is provided with a foaming agent and a decorative member formed at a front surface of the front panel.

The door frame includes a plurality of vertical frames and horizontal frames coupled to each other.

Each vertical frame includes a first seat section forming a front surface to which the front panel is seated, a lateral section forming a side surface, and a second seat section forming a rear surface to which the rear panel is seated.

A chassis is coupled to each vertical frame to fix the decorative member.

The chassis includes a first coupling section coupled to the first seat section, a second coupling section coupled to the lateral section, and a support section forming an insertion hole together with the first coupling section in order to support the decorative member inserted into the insertion hole.

The horizontal frames include upper and lower horizontal frames coupled to upper and lower ends of the vertical frames to form a rectangular frame together with the vertical frames, and a first horizontal frame interposed between the vertical frames.

The front panel includes paper or plastic.

The plastic includes DANPLA.

According to another aspect of the present invention, there is provided a method of manufacturing a door of a refrigerator, the method comprising forming a door frame by coupling a plurality of vertical and horizontal frames to each other, coupling a front panel to a front surface of the door frame, filling a foaming cavity defined by the door frame and the front panel with foaming solution, and foaming the foaming solution after coupling a rear panel to a rear surface of the door frame.

The method further includes forming a chamfer at an edge portion of each vertical frame.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF THE EMBODIMENTS

Figure 1:
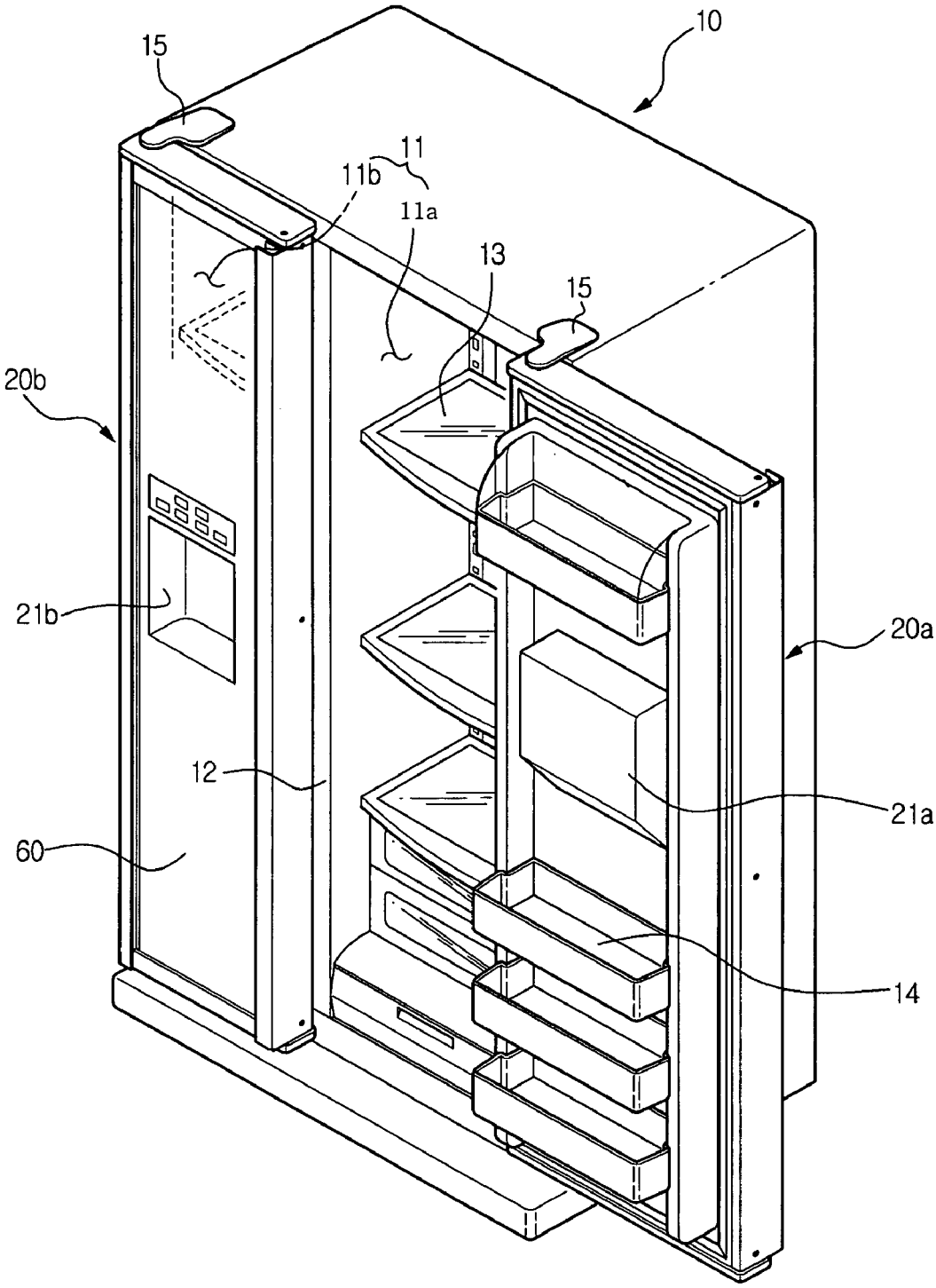
FIG. 1 is a perspective view illustrating a refrigerator according to an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

Hereinafter, exemplary embodiments of the present invention will be described with reference to the accompanying drawings.

FIG. 1 is a perspective view illustrating a refrigerator according to an exemplary embodiment of the present invention.

As shown in FIG. 1, the refrigerator according to the present invention includes a body 10 having a storeroom 11 storing foodstuffs, and doors 20*a* and 20*b* rotatably coupled to the body 10 to open/close the storeroom 11.

The storeroom 11 is divided into a cooling chamber 11*a* to cool and store foodstuffs and a freezing chamber 11*b* to freeze and store foodstuffs. The cooling chamber 11*a* and the freezing chamber 11*b* are opened or closed by the cooling chamber door 20*a* and the freezing chamber door 20*b*, respectively.

Hinge units 15 are installed at upper and lower ends of the body 10 such that the doors 20*a* and 20*b* can be rotatably coupled to the body 10 to open/close the storerooms 11.

A plurality of shelves 13 are installed in the storeroom 11 so as to receive vessels containing foods, and racks 14 are provided at inner portions of the doors 20*a* and 20*b* in order to receive water bottles and the like. In addition, the cooling chamber door 20*a* is provided with a home bar 21*a* allowing a user to take out water bottles and the like without opening the cooling chamber door 20*a*, and the freezing chamber door 20*b* is provided with a dispenser 21*b* allowing the user to have water or ice without opening the freezing chamber door 20*b*.

Decorative members 60 made from, for example, wood or tempered glass are installed at front surfaces of the doors 20*a* and 20*b* so as to improve the external appearance of the refrigerator.

Hereinafter, the structure and manufacturing method of the doors 20*a* and 20*b* shown in FIG. 1 will be described in detail with reference to FIGS. 2 to 6. The structure of the cooling chamber door 20*a* is very similar to the structure of the freezing chamber door 20*b*, so the doors 20*a* and 20*b* will be commonly referred to as a door 20 in the following description.

Figure 2:
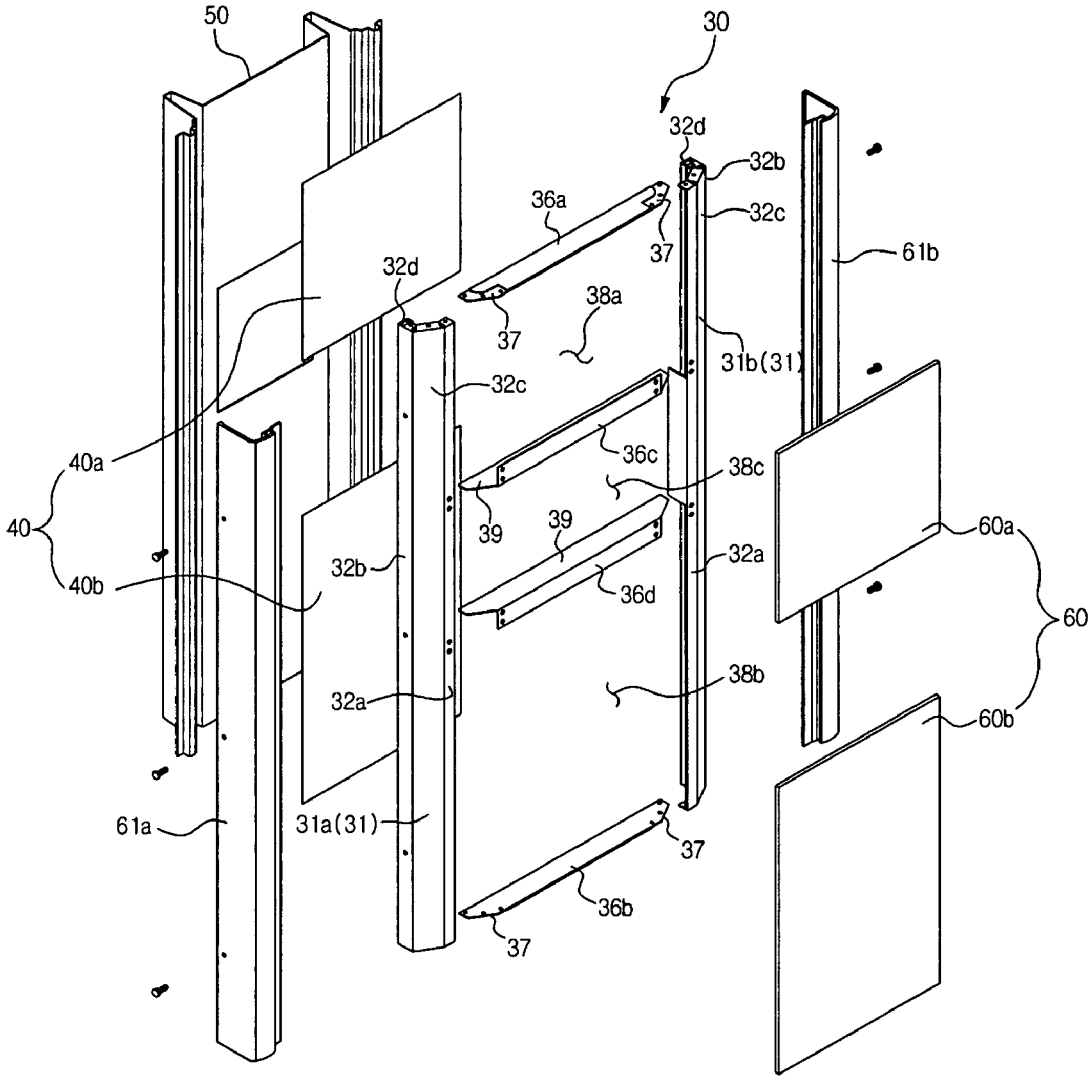
FIG. 2 is an exploded perspective view of a door used in the refrigerator shown in FIG. 1.

As shown in FIG. 2, the door 20 includes a door frame 30, a front panel 40 coupled to a front portion of the door frame 30 to prevent a foaming agent from being leaked in the front direction, a rear panel 50 coupled to a rear portion of the door frame 30 to form a foaming space together with the front panel 40 and provided with a rack 14 receiving water bottles and the like, and chassis 61*a* and 61*b* coupled to the door frame 30 to fix the decorative members 60.

The door frame 30 includes a plurality of vertical frames 31 and horizontal frames 36*a*-36*d* coupled with each other.

Although FIG. 2 shows two vertical frames 31 and four horizontal frames 36, the present invention is not limited thereto, and the door frame 30 may have various structures using different numbers of vertical frames 31 and horizontal frames 36.

The vertical frames 31 include first and second vertical frames 31*a* and 31*b*, each of which is provided with a first seat section 32*a* forming a front surface, a lateral section 32*b* forming a side surface, a chamfer section 32*c* slantingly interposed between the first seat section 32*a* and the lateral section 32*b*, and a second seat section 32*d* forming a rear surface to which the rear panel 50 is seated. Such a vertical frame 31 is fabricated by bending a metallic plate several times.

An upper horizontal frame 36*a* and a lower horizontal frame 36*b* are coupled to upper and lower ends of the first and second vertical frames 31*a* and 31*b*, respectively, thereby forming a rectangular frame together with the first and second vertical frames 31*a* and 31*b*. In addition, a first horizontal frame 36*c* forming a first opening 38*a* together with the upper horizontal frame 36*a* and a second horizontal frame 36*d* forming a second opening 38*b* together with the lower horizontal frame 36*b* are coupled between the first and second vertical frames 31*a* and 31*b*.

End portions of the upper and lower horizontal frames 36*a* and 36*b* are formed with taper sections 37 having shapes corresponding to end portions of the first and second vertical frames 31*a* and 31*b*, while forming a predetermined flat surface such that foaming agent is prevented from being leaked in the upward or downward direction.

A third opening 38*c* is formed between the first and second horizontal frames 36*c* and 36*d*. The third opening 38*c* is not filled with foaming agent, so that the third opening 38*c* can be used as a space for the home bar 21*a* or the dispenser 21*b*. In order to prevent the foaming agent from penetrating into the third opening 38*c*, partition walls 39 are formed at the first and second horizontal frames 36*c* and 36*d*.

The front panel 40 includes a first front panel 40*a* provided between the upper horizontal frame 36*a* and the first horizontal frame 36*c* to form a first foaming cavity, and a second front panel 40*b* provided between the lower horizontal frame 36*b* and the second horizontal frame 36*d* to form a second foaming cavity.

The first and second front panels 40*a* and 40*b* are made from inexpensive paper or plastics having light weight and predetermined strength, rather than expensive metallic plates having heavy weight.

The paper or plastic may have thin thickness and predetermined strength. The paper may include strawboard, and the plastic may include DANPLA.

In particular, the DANPLA is a plastic carbon board having a hollow structure or a corrugated structure, which is obtained by extruding polypropylene (PP) copolymer. The DANPLA not only has higher strength and light weight, but also represents superior water-resistant, oil-resistant and medicine-resistant characteristics, so the DANPLA can be used for the front panels 40*a* and 40*b*.

Figure 3:
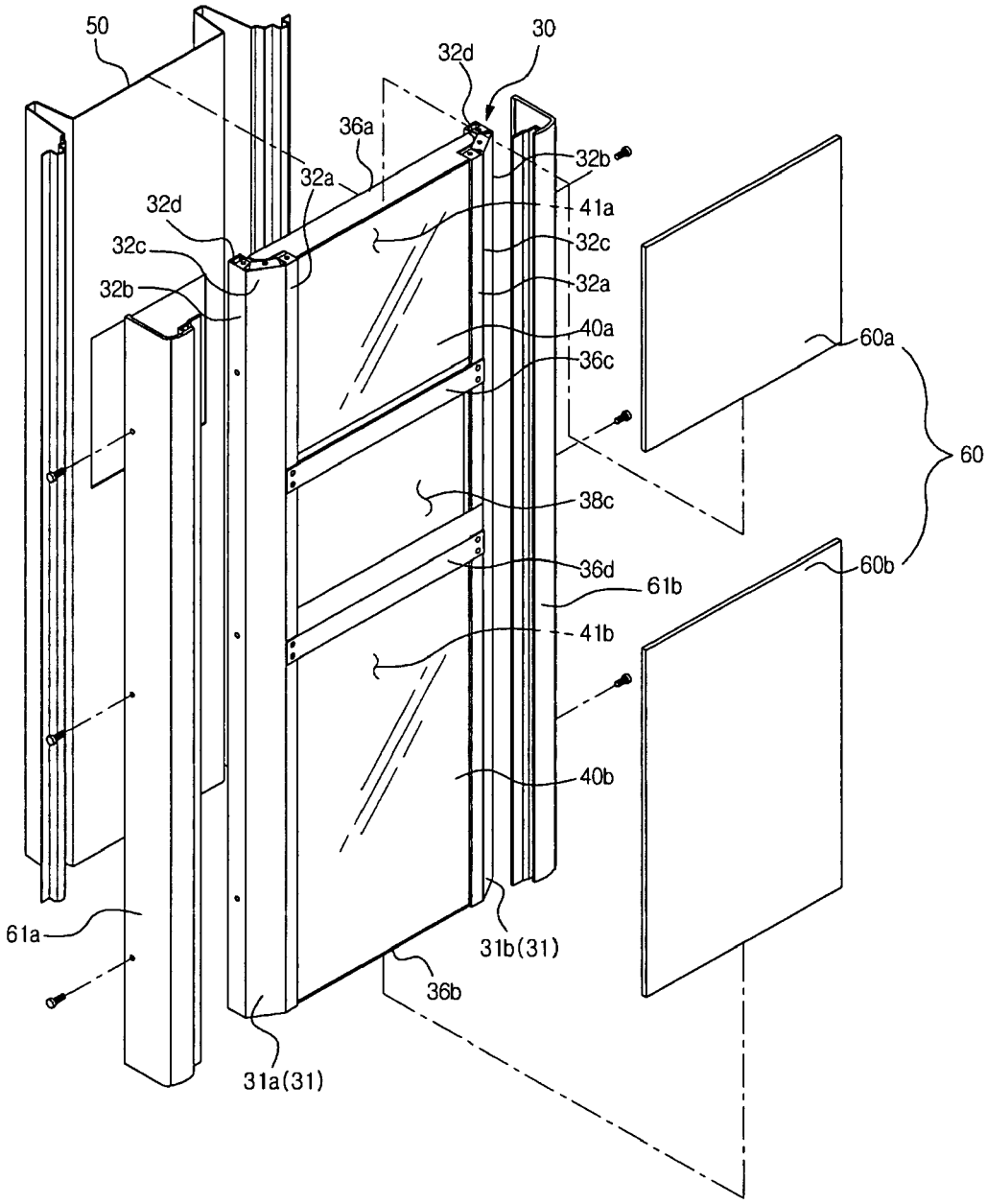
FIG. 3 is an exploded perspective view illustrating a frame and a front panel shown in FIG. 2.

FIG. 3 is an exploded perspective view showing the vertical frames 31 coupled with horizontal frames 36 to form the door frame 30, and the first and second front panels 40*a* and 40*b* coupled to the door frame 30 to form the first and second foaming cavities 41*a* and 41*b*.

When the first and second front panels 40*a* and 40*b* are coupled to the door frame 30, the first and second front panels 40*a* and 40*b* are supported on the first seat section 32*a* of the first and second vertical frames 31*a* and 31*b*, so that the first and second foaming cavities 41*a* and 41*b* are formed at rear portions of the first and second front panels 40*a* and 40*b*.

In a state in which the first and second front panels 40*a* and 40*b* are coupled to the door frame 30, the door frame 30 is laid down and then foaming solution is filled in the first and second foaming cavities 41*a* and 41*b*. After that, the rear panel 50 is coupled to the door frame 30. After placing the rear panel 50 on the second seat sections 32*a* of the first and second vertical frames 31*a* and 31*b*, the rear panel 50 is fixed to the door frame 30 by a jig (not shown).

Figure 4:
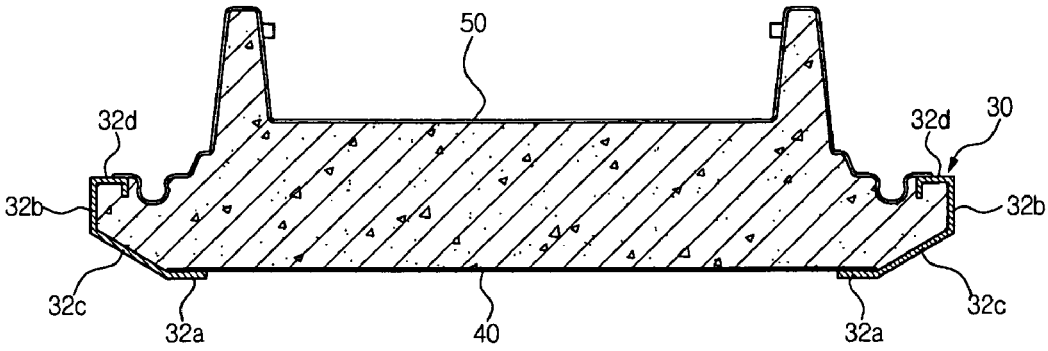
FIG. 4 is a sectional view illustrating foaming agent filled between a front panel and a rear panel of the door of FIG. 1.

The foaming solution is foamed in the first and second foaming cavities 41*a* and 41*b*, so that the first and second foaming cavities 41*a* and 41*b* are fully filled with foaming agent. Thus, as shown in FIG. 4, the door frame 30 is integrally formed with the rear panel 50.

Since chamfer sections 32*c* are formed at edge portions of the first and second vertical frames 31*a* and 31*b*, rigidity and strength of the edge portions of the first and second vertical frames 31*a* and 31*b* can be enhanced. In addition, since the foaming agent is not filled in the edge portions of the first and second vertical frames 31*a* and 31*b*, an amount of foaming agent to be filled in the door 20 can be reduced, so the manufacturing cost for the door 20 can be saved.

Figure 5:
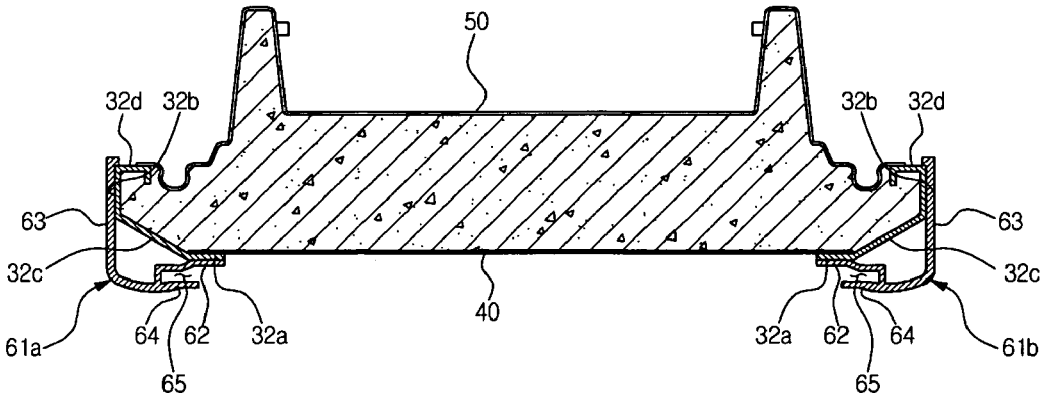
FIG. 5 is a sectional view illustrating a chassis coupled to front and rear panels of the door of FIG. 1.

In a state in which the door frame 30 has been integrally coupled with the rear panel 50, the decorative member 60 is installed at the front surface of the door frame 30 as shown in FIG. 5. To this end, the first chassis 61*a* is installed on the first vertical frame 31*a* and the second chassis 61*b* is installed on the second vertical frame 31*b*. Air gaps are formed between inner surfaces of the vertical frames 31*a*, 31*b* and front corner regions of the respective chassis 61*a*, 61*b*. At this time, the first and second chassis 61*a* and 61*b* can be coupled to the first and second vertical frames 31*a* and 31*b* by bolts or rivets. The first and second chassis 61*a* and 61*b* are fabricated by using aluminum having light weight and higher strength.

Each of the first and second chassis 61*a* and 61*b* includes a first coupling section 62 coupled to the first seat section 32*a* and a second coupling section 63 coupled to the lateral section 32*b*. In addition, a support section 64 is provided while being spaced apart from the first coupling section 62 by a predetermined distance to support the front surface of the decorative member 60.

An insertion hole 65 is formed between the first coupling section 62 and the support section 64 to receive the decorative member 60.

After the first and second chassis 61*a* and 61*b* have been installed on the door frame 30, the decorative member 60 is inserted into the insertion hole 65 to improve the aesthetic appearance of the door 20. The decorative member 60 includes a first decorative member 60*a* installed above the third opening 38*c* and a second decorative member 60*b* installed below the third opening 38*c*. The decorative member 60 may include wood or tempered glass, but is not limited thereto.

Figure 6:
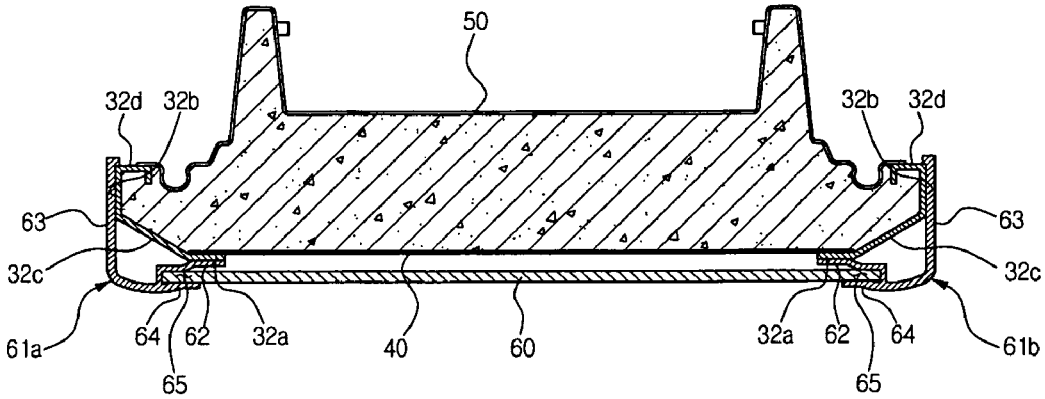
FIG. 6 is a sectional view illustrating a decorative member coupled to a chassis of the door of FIG. 1.

FIG. 6 is a sectional view showing the decorative member 60 inserted into the insertion hole 65 of the first and second chassis 61*a* and 61*b*. As shown in FIG. 6, the decorative member 60 is fixedly supported by the first coupling section 62 and the support section 64.

Accordingly, the decorative member 60 is stably supported. The external appearance of the refrigerator can be changed by replacing the decorative member 60.

As described above, according to the refrigerator of the embodiments of the present invention, the door frame made from a metallic plate is provided to support predetermined regions of the door where sufficient rigidity and strength are necessary, and the front panel made from inexpensive paper or plastic is provided to support predetermined regions of the door where rigidity and strength are not necessary. Thus, the manufacturing cost for the door can be reduced.

In addition, since the chamfer section is formed at the edge portion of the door frame, rigidity and strength of the edge portion can be improved. Further, since the foaming agent is not filled in a cavity defined by the edge portion, the amount of the foaming agent can be reduced, so that the manufacturing cost for the door can be reduced.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body having a storeroom therein; and a door to open/close the storeroom, wherein the door includes a door frame having a front panel portion, a rear panel portion, a first vertical frame portion, a second vertical frame portion, an upper horizontal frame portion, and a lower horizontal frame portion, to define a foaming cavity therein, which is filled with a foaming agent, wherein the door further includes a left chassis and a right chassis installed to the door frame to support a decorative member in front of the front panel portion of the door frame such that the decorative member is spaced a predetermined distance from the front panel portion of the door frame, wherein the left chassis is installed to the door frame such that a first air gap is formed between an inner surface of the left chassis and a front left corner region of the door frame, wherein the right chassis is installed to the door frame such that a second air gap is formed between an inner surface of the right chassis and a front right corner region of the door frame wherein the door frame further includes a first chamfer section formed at the front left corner region thereof and a second chamfer section formed at the front right corner region thereof, wherein the first air gap is defined in part by the first chamfer section and the second air gap is defined in part by the second chamfer section.

2. The refrigerator as claimed in claim 1, wherein each of the vertical frame portions includes a first seat section forming a front surface to which the front panel portion is seated, a lateral section forming a side surface, and a second seat section forming a rear surface to which the rear panel portion is seated.

3. The refrigerator as claimed in claim 2, wherein each of the vertical frame portions includes a chamfer section slantingly interposed between the first seat section and the lateral section.

4. The refrigerator as claimed in claim 1, wherein the left chassis and the right chassis are coupled to each respective ones of the vertical frame portions to support the decorative member.

5. The refrigerator as claimed in claim 2, wherein each of the left chassis and the right chassis includes a first coupling section coupled to the first seat section, a second coupling section coupled to the lateral section, and a support section forming an insertion hole together with the first coupling section in order to support the decorative member inserted into the insertion hole.

6. The refrigerator as claimed in claim 1, further comprising a first horizontal frame interposed between the vertical frame portions to form a first opening together with the upper horizontal frame portion, and a second horizontal frame forming a second opening together with the lower horizontal frame portion.

7. The refrigerator as claimed in claim 1, wherein the front panel includes paper or plastic.

8. The refrigerator as claimed in claim 7, wherein the plastic includes DANPLA.

9. The refrigerator as claimed in claim 1, wherein the left chassis and the right chassis are fabricated from aluminum material and installed to the door frame via a plurality of fastener elements.

10. The refrigerator as claimed in claim 6, wherein the first horizontal frame comprises a partition wall having a lower portion to form the first opening and the second horizontal frame comprises a partition wall at an upper portion thereof.

11. A method of manufacturing a door of a refrigerator, the method comprising:

forming a door frame comprising a front panel portion, a rear panel portion, a first vertical frame portion, a second vertical frame portion an upper horizontal frame portion, and a lower horizontal frame portion to define a foaming cavity therein;

filling the foaming cavity of the door frame with a foaming solution;

and installing a left chassis and a right chassis to the door frame to support a decorative member in front of the front panel portion of the door frame such that the decorative member is spaced a predetermined distance from the front panel portion of the door frame, comprising:

installing the left chassis to the door frame such that a first air gap is formed between an inner surface of the left chassis and a front left corner region of the door frame, and installing the right chassis to the door frame such that a second air gap is formed between an inner surface of the right chassis and a front right corner region of the door frame wherein the door frame includes a first chamfer section formed at the front left corner region thereof and a second chamfer section formed at the front right corner region thereof, wherein the first air gap is defined in part by the first chamfer section and the second air gap is defined in part by the second chamfer section.

12. The method as claimed in claim 11, wherein the left chassis and the right chassis are fabricated from aluminum material and installed to the door frame via a plurality of fastener elements.

* * * * *

UNITED STATES PATENT AND TRADEMARK OFFICE

CERTIFICATE OF CORRECTION

PATENT NO. : 8,104,853 B2
APPLICATION NO. : 11/987112
DATED : January 31, 2012
INVENTOR(S) : Myung Soo Kim et al.

It is certified that error appears in the above-identified patent and that said Letters Patent is hereby corrected as shown below:

First Page, Col. 1 (Inventors), Line 2, Delete “Gwanglu” and insert -- Gwangju --, therefor.

First Page, Col. 1 (Inventors), Line 3, Delete “Gwanglu” and insert -- Gwangju --, therefor.

First Page, Col. 1 (Inventors), Line 4, Delete “Gwanglu” and insert -- Gwangju --, therefor.

First Page, Col. 1 (Inventors), Line 5, Delete “Gwanglu” and insert -- Gwangju --, therefor.

First Page, Col. 1 (Inventors), Line 6, Delete “Soocheon-si” and insert -- Sooncheon-si --, therefor.

Column 6, Line 8, In Claim 1, delete “portion, to” and insert -- portion to --, therefor.

Column 6, Line 24, In Claim 1, delete “frame wherein” and insert -- frame, wherein --, therefor.

Column 6, Line 42, In Claim 4, after “to” delete “each”.

Column 7, Line 7, In Claim 11, delete “portion” and insert -- portion, --, therefor.

Column 8, Line 8, In Claim 11, delete “frame wherein” and insert -- frame, wherein --, therefor.

Signed and Sealed this
Nineteenth Day of June, 2012

David J. Kappos

David J. Kappos
*Director of the United States Patent and Trademark Office*